US009542886B2

(12) United States Patent
Wang

(10) Patent No.: US 9,542,886 B2
(45) Date of Patent: Jan. 10, 2017

(54) ORGANIC LIGHT EMITTING DISPLAY DEVICE AND METHOD FOR DRIVING THE SAME

(71) Applicant: SAMSUNG DISPLAY CO., LTD., Yongin, Gyeonggi-Do (KR)

(72) Inventor: In-Soo Wang, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 54 days.

(21) Appl. No.: 14/531,198

(22) Filed: Nov. 3, 2014

(65) Prior Publication Data

US 2015/0124005 A1 May 7, 2015

(30) Foreign Application Priority Data

Nov. 4, 2013 (KR) ..... 10-2013-0132687

(51) Int. Cl.
*G09G 3/3291* (2016.01)
*G09G 3/32* (2016.01)

(52) U.S. Cl.
CPC .... *G09G 3/3233* (2013.01); *G09G 2300/0861* (2013.01)

(58) Field of Classification Search
CPC ..... G09G 3/3291; G09G 3/3233; G09G 2300/0819; G09G 2300/0852
See application file for complete search history.

(56) References Cited

U.S. PATENT DOCUMENTS

| | | | | |
|---|---|---|---|---|
| 8,207,918 | B2 | 6/2012 | Kohno et al. | |
| 8,284,124 | B2 | 10/2012 | Kim et al. | |
| 2012/0147060 | A1 | 6/2012 | Jeong | |
| 2012/0169693 | A1 | 7/2012 | Tsai et al. | |
| 2012/0199891 | A1 | 8/2012 | Suzuki et al. | |
| 2013/0088417 | A1* | 4/2013 | Kim | G09G 3/3233 345/82 |
| 2013/0335391 | A1* | 12/2013 | Kim | G09G 3/3291 345/211 |

FOREIGN PATENT DOCUMENTS

| | | |
|---|---|---|
| JP | 2011-107441 | 6/2011 |
| JP | 2012-022187 | 2/2012 |
| KR | 10-2012-0065137 | 6/2012 |

* cited by examiner

*Primary Examiner* — Ricardo L Osorio
(74) *Attorney, Agent, or Firm* — Lee & Morse, P.C.

(57) ABSTRACT

A pixel includes a driving transistor, an organic light emitting diode, a first transistor, and the second transistor. The driving transistor includes a gate electrode coupled to a first node, a first electrode coupled to a second node, and a drain electrode coupled to a third node. The driving transistor controls an amount of drain-source current based on a level of a voltage applied to the first node. The first transistor is coupled between the second node and a data line, and turns on by a scan signal of a scan line. The second transistor is coupled between the first node and an initialization voltage line, and turns on by an initialization signal of an initialization line. The first and second transistors are turned on during a first period.

18 Claims, 8 Drawing Sheets

ORGANIC LIGHT EMITTING DISPLAY DEVICE AND METHOD FOR DRIVING THE SAME

CROSS-REFERENCE TO RELATED APPLICATION

Korean Patent Application No. 10-2013-0132687, filed on Nov. 4, 2013, and entitled, "ORGANIC LIGHT EMITTING DISPLAY DEVICE AND METHOD FOR DRIVING THE SAME," is incorporated by reference herein in its entirety.

BACKGROUND

1. Field

One or more embodiments described herein relate to a display device and a method for driving a display device.

2. Description of the Related Art

A variety of flat panel displays have been developed. Examples include liquid crystal displays, plasma display panels, and organic light emitting displays. Among these, the organic light emitting display is driven at a low voltage, has a wide viewing angle, a quick response speed, and thin dimensions.

An organic light emitting display has a plurality of pixels arranged in matrix form. Each pixel includes a scan transistor and a driving transistor. The scan transistor provides a data voltage from a data line in response to a scan signal. The driving transistor adjusts the amount of the current supplied to an organic light emitting diode based on a voltage supplied to its gate electrode.

SUMMARY

In accordance with one embodiment, a display device includes a display panel including data lines, scan lines, initialization lines, and a plurality of pixels, each pixel including: a driving transistor including a gate electrode coupled to a first node, a first electrode coupled to a second node, and a drain electrode coupled to a third node, the driving transistor configured to control an amount of drain-source current based on a level of a voltage applied to the first node; an organic light emitting diode (OLED) configured to emit light based on the drain-source current; a first transistor coupled between the second node and a data line, the first transistor configured to be turned on by a scan signal of a scan line; and a second transistor coupled between the first node and an initialization voltage line to supply an initialization voltage, the second transistor configured to be turned on by an initialization signal of an initialization line, wherein the first and second transistors are to be turned on during a first period.

The pixel may include a third transistor coupled between the first node and third node, the third transistor configured to be turned on by the scan signal during the first period. The first and third transistors may be turned off and the second transistor may be turned on during a second period subsequent to the first period. The first and third transistor may be turned on and the second transistor is to be turned off during a third period subsequent to the second period.

The display panel may include emission lines, and each pixel may include: a fourth transistor coupled between the second node and a first voltage supply line to supply a first power voltage, the fourth transistor configured to be turned on by an emission signal of an emission line; and a fifth transistor coupled between the third node and the organic light emitting diode, the fifth transistor configured to be turned on by the emission signal. The fourth and fifth transistors may be turned off during the first to third periods.

The first to third transistors may be turned off and the fourth and fifth transistors may be turned on during a fourth period subsequent to the third period.

The scan signal and initialization signal may be generated as a first logic level voltage and the emission signal may be generated as a second level voltage during the first period. The initialization signal may be generated as the first logic level voltage and the scan signal and emission signal may be generated as the second level voltage during the second period.

The scan signal may be generated as the first logic level voltage and the initialization signal and emission signal are to be generated as the second level voltage during the third period. The emission signal may be generated as the first logic level voltage and the scan signal and initialization signal may be generated as the second level voltage during the fourth period.

Each of the first to fifth transistors may be turned on by the first logic level voltage and may be turned off by the second logic level voltage. Each of the first to third periods may include a plurality of horizontal periods.

The first transistor may include a gate electrode coupled to the scan line, a first electrode coupled to the data line, and a second electrode coupled to the second node, the second transistor may include a gate electrode coupled to the initialization line, a first electrode coupled to the first node, a second electrode coupled to the initialization voltage line, the third transistor may include a gate electrode coupled to the scan line, a first electrode coupled to the third node, a second electrode coupled to the first node, the fourth transistor may include a gate electrode coupled to the emission line, a first electrode coupled to the first voltage supply line, a second electrode coupled to the second node, the fifth may include a gate electrode coupled to the emission line. A first electrode may be coupled to the third node, a second electrode may be coupled to an anode of the OLED, and a cathode of the organic light emitting diode may be coupled to a second voltage supply line to supply a second power voltage. The pixel may include a capacitor coupled between the first node and a first voltage supply line to supply a first power voltage.

In accordance with another embodiment, a method for driving a display device includes supplying a gate-on voltage to a driving transistor of a pixel; initializing a gate electrode of the driving transistor; supplying a data voltage to the gate electrode of the driving transistor; and controlling an organic light emitting diode (OLED) to emit light, wherein the OLED is coupled to the driving transistor emits light based on a drain-source current of the driving transistor.

Supplying the gate-on voltage may include supplying the data voltage to a first electrode of the driving transistor from a data line, connecting the gate electrode of the driving transistor to a second electrode of the driving transistor; and connecting the gate electrode of the driving transistor to an initialization voltage line supplying an initialization voltage. Initializing the gate electrode may include connecting the gate electrode of the driving transistor to an initialization voltage line supplying an initialization voltage.

Supplying the data voltage may include supplying the data voltage to a first electrode of the driving transistor from a data line, and connecting the gate electrode of the driving transistor to a second electrode of the driving transistor. Controlling the OLED to emit light may include connecting a first electrode of the driving transistor to a first voltage supply line supplying a first power voltage, and connecting a second electrode of the driving transistor to the OLED.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
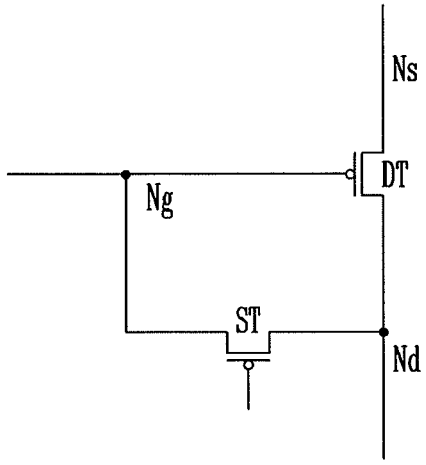
FIG. 1 illustrates an example of a pixel circuit in a diode-connected state for compensating the threshold voltage of a driving transistor.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

When a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 illustrates a pixel circuit in a diode-connected state for compensating the threshold voltage of a driving transistor DT. The driving transistor DT supplies a current to an organic light emitting diode (OLED), and a switch transistor ST is coupled between a gate node Ng and a drain node Nd.

Referring to FIG. 1, switch transistor ST connects gate node NG and drain node Nd during a data voltage supply period, during which a data voltage is supplied to a source node Ns. In this configuration, the driving transistor DT is diode-connected. The voltage of gate node Ng and the voltage of drain node Nd may have substantially the same potential. If a voltage difference Vgs between gate node Ng and source node Ns is greater than a threshold voltage of driving transistor DT, driving transistor DT forms a current path until the voltage difference Vgs between the gate node Ng and source node Ns reaches the threshold voltage Vth of driving transistor DT. As a result, the voltage of gate node Ng and the voltage of drain node Nd rise.

Therefore, if a data voltage Vdata is supplied to source node Ns, the voltage of gate node Ng and the voltage of drain node Nd reaches a voltage difference Vdata-Vth between the data voltage Vdata and threshold voltage Vth of the driving transistor DT. As a result, the diode-connected state of the pixel may allow Vth to drop out of Equation 1, thereby compensating the threshold voltage Vth of driving transistor DT.

$$I_{ds}=k\cdot(V_{gs}-V_{th})^2 \quad (1)$$

In Equation 1, Ids is the drain-source current of the driving transistor supplied to the OLED, k is a proportionality coefficient determined by the structure and physical properties of the driving transistor, Vgs is the gate-source voltage of the driving transistor, and Vth is the threshold voltage of the driving transistor.

Figure 2:
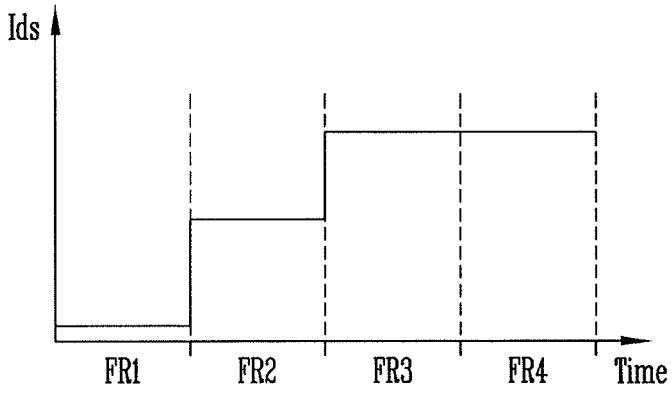
FIG. 2 illustrates an example of a drain-source current of the driving transistor caused by the hysteresis of the driving transistor.

FIG. 2 illustrates an example of a drain-source current of the driving transistor caused by hysteresis characteristics of the driving transistor in FIG. 1. In FIG. 2, a first frame period FR1 is a black gray scale display period in which a pixel emits a black gray scale value. The second to fourth frame periods FR2 to FR4 are white gray scale display periods in which a pixel emits light of a white gray scale value.

Referring to FIG. 2, the drain-source current of driving transistor DT increases in steps by hysteresis characteristics of driving transistor DT when a pixel emits light of a white gray scale value after representing a black gray scale value. This may occur, for example, when driving transistor DT is formed by a low temperature Poly-Si (LTPS) process.

More specifically, in certain circumstances, the drain-source current of the driving transistor DT may increase in steps during the first to fourth frame periods due to differences of the drain-source current in on-state and off-bias states. An on-bias state may include a state in which the driving transistor DT is turned on and the drain-source current Ids flows through a channel of driving transistor DT. A white gray scale voltage may be supplied to the gate electrode of the driving transistor DT to place the driving transistor is the on-bias state.

An off-bias state may correspond to when the driving transistor DT is turned off and the drain-source current Ids hardly flows through the channel of the driving transistor DT, if at all. A black gray scale voltage may be supplied to the gate electrode of the driving transistor DT to place the driving transistor is the off-bias state.

A white gray scale voltage may include a voltage for causing an OLED to emit light of a white gray scale value. A black gray scale voltage may include a voltage for causing an OLED to emit light of a black gray scale value.

A black gray scale voltage is supplied to the gate electrode of driving transistor DT during first frame period FR1. Thus, driving transistor DT is in the off-bias state during second frame period FR2. Also, because the white gray scale voltage is supplied to the gate electrode of driving transistor DT during the second frame period FR2, the driving transistor DT is in the on-bias state during the third frame period. For example, driving transistor DT is not in the same bias state during the second and third frame periods FR2 and FR3, even though the same white gray scale voltage is supplied to the gate electrode of driving transistor DT during the second and third frame periods FR2 and FR3.

As a result, as shown in FIG. 2, the drain-source current of driving transistor DT during the second frame period FR2 is lower than during the third frame period FR3, even though the same white gray scale voltage is supplied to the gate electrode of driving transistor DT. Therefore, the luminance of light emitted from an OLED during the second frame period FR2 is lower than during the third frame period FR3. Accordingly, picture quality may be lowered due to a luminance difference between the second and third frame periods FR2 and FR3.

In accordance with one embodiment, picture quality may be improved by minimizing a luminance difference between white gray scale display periods caused by hysteresis characteristics of a driving transistor DT.

Figure 3:
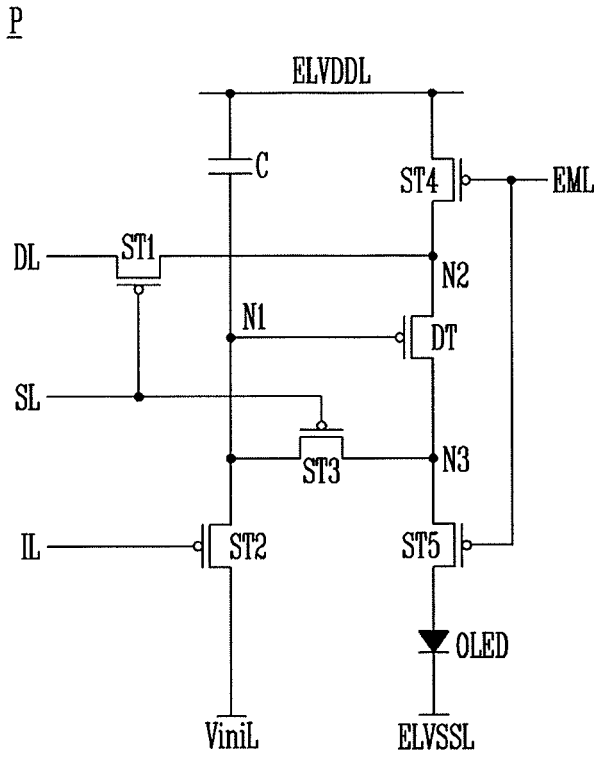
FIG. 3 illustrates an embodiment of a pixel.

FIG. 3 illustrates an embodiment of a pixel P connected to a scan line SL, a data line DL, an initialization line IL, and an emission line EML. Also, pixel P is connected to first and second voltage supply lines ELVDDL, ELVSSL and an initialization voltage line ViniL.

In this embodiment, pixel P includes a driving transistor DT, an OLED, switch elements, and a capacitor C. The switch elements include first to fifth transistors ST1 to ST5. The driving transistor DT controls the amount of drain-source current based on the level of a voltage applied to a gate electrode of the driving transistor DT.

The drain-source current Ids of the driving transistor DT is proportional to a square of the difference between the gate-source voltage Vgs of the driving transistor and the threshold voltage Vth of the driving transistor, for example, as described in Equation 1.

A gate electrode of the driving transistor DT is coupled to a first node N1. A first electrode of the driving transistor DT is coupled to a second node N2. A drain electrode of the driving transistor DT is coupled to a third node N3. The first and second electrodes may be source and drain electrodes. For example, if the first electrode is the source electrode, the second electrode may be the drain electrode.

The OLED emits light depending on the drain-source current Ids of the driving transistor DT. In this embodiment, the anode of the OLED is coupled to a second electrode of the fifth transistor ST5, and the cathode is coupled to a second voltage supply line ELVSSL supplying a second power voltage ELVSS.

The first transistor ST1 is coupled between second node N2 and data line DL. The first transistor ST1 is turned on by a scan signal from scan line SL. When the first transistor ST1 is turned on, the second node N2 is coupled to data line DL and a data voltage Vdata from data line DL is supplied to the second node N2. A gate electrode of the first transistor ST1 is coupled to the scan line SL, a first electrode thereof is coupled to the data line DL, and a second electrode thereof is coupled to the second node N2.

The second transistor ST2 is coupled between the first node N1 and the initialization voltage line ViniL supplying initialization voltage Vini. The second transistor ST2 is turned on by an initialization signal from initialization line IL. When the second transistor ST2 is turned on, the first node N2 is coupled to initialization voltage line ViniL and the first node N1 is initialized to initialization voltage Vini. A gate electrode of the second transistor ST2 is coupled to initialization line SL, a first electrode thereof is coupled to first node N1, and a second electrode thereof is coupled to initialization voltage line ViniL.

The third transistor ST3 is coupled between the first node N1 and third node N3. The third transistor ST3 is turned on by a scan signal from scan line SL. When the third transistor ST3 is turned on, the first node N1 is coupled to third node N3 and the driving transistor DT is diode-connected. A gate electrode of the third transistor ST3 is coupled to scan line SL, a first electrode thereof is coupled to the third node N3, and a second electrode thereof is coupled to the first node N1.

The fourth transistor ST4 is coupled between the second node N2 and first voltage supply line ELVDDL supplying first power voltage ELVDD. The fourth transistor ST4 is turned on by an emission signal from emission line EML. When the fourth transistor ST4 is turned on, the second node N2 is coupled to first voltage supply line ELVDDL and the first power voltage ELVDD is supplied to second node N2. A gate electrode of the fourth transistor ST4 is coupled to emission line EML, a first electrode thereof is coupled to the first voltage supply line ELVDDL, and a second electrode thereof is coupled to the second node N2.

The fourth transistor ST4 is coupled between the second node N2 and first voltage supply line ELVDDL supplying first power voltage ELVDD. The fourth transistor ST4 is turned on by an emission signal from emission line EML. When the fourth transistor ST4 is turned on, the second node N2 is coupled to the first voltage supply line ELVDDL and the first power voltage ELVDD is supplied to the second node N2. A gate electrode of the fourth transistor ST4 is coupled to emission line EML, a first electrode thereof is coupled to the first voltage supply line ELVDDL, and a second electrode thereof is coupled to the second node N2.

The fifth transistor ST5 is coupled between the third node N3 and the anode of the OLED. The fifth transistor ST5 is turned on by the emission signal from emission line EML. When the fifth transistor ST5 is turned on, the third node N3 is coupled to the anode of the OLED. A gate electrode of the fifth transistor ST5 is coupled to emission line EML, a first electrode thereof is coupled to the third node N3, and a second electrode thereof is coupled to the anode of the OLED. When the fourth and fifth transistors are turned-on, the drain-source current Ids of the driving transistor DT is supplied to the OLED.

The capacitor C is coupled between the first node N1 and first voltage supply line ELVDDL. For example, one electrode of capacitor C is coupled to first node N1 and the other electrode of capacitor C is coupled to first voltage supply line ELVDDL.

The first node N1 is a gate node coupled to the gate electrode of driving transistor DT. The first node N1 is a contact point for gate electrode of the driving transistor DT, the second electrode of the third transistor ST3, the first electrode of the second transistor ST2, and one electrode of the capacitor C.

The second node N2 is a source node coupled to the first electrode of the driving transistor DT. The second node N2 is a contact point for the first electrode of the driving transistor DT, the second electrode of the first transistor ST1, and the second electrode of the fourth transistor ST4. The third node N3 is a drain node coupled to the second electrode of the driving transistor DT. The third node N3 is a contact point at which the second electrode of the driving transistor DT, the first electrode of the third transistor ST3, and the first electrode of the fifth transistor ST5.

Semiconductor layers of the first to fifth transistors ST1 to ST5 and driving transistor DT may be formed, for example, of Poly-Si by a low temperature Poly-Si (LTPS) process. In other embodiments, and the semiconductor layers of the first to fifth transistors ST1 to ST5 and driving transistor DT may be formed of a-Si or an oxide semiconductor.

Also, first to fifth transistors ST1 to ST5 and driving transistor DT are illustrated as P-type transistors. In other embodiments, first to fifth transistors ST1 to ST5 and driving transistor DT may be N-type transistors. When the first to fifth transistors ST1 to ST5 and driving transistor DT are implemented as N-type transistors, the waveform diagram in FIG. 4 may be modified in accordance with the characteristics of N-type transistors.

The first and second power voltage ELVDD and ELVSS and initialization voltage Vini may be set after consideration of the characteristics of the driving TFT transistor, the characteristics of the OLED, and/or other circuit elements. The first power voltage ELVDD may be set to a voltage higher than second power voltage ELVSS. A voltage which subtracts initialization voltage Vini from data voltage Vdata may be lower than the threshold voltage Vth of the driving transistor DT.

Figure 4:
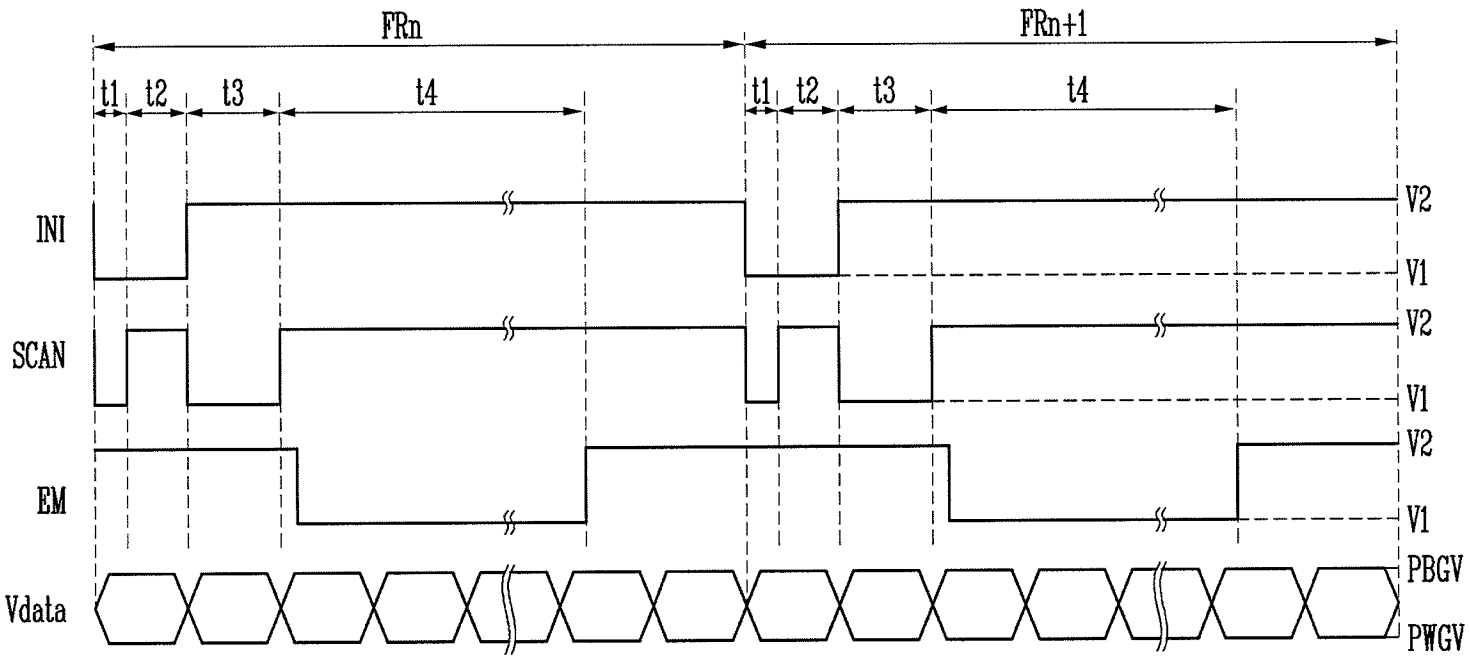
FIG. 4 illustrates an embodiment of pixel control and data signals.

FIG. 4 illustrates an embodiment of control and data signals for a pixel, which, for example, may be the pixel in FIG. 3. The control signals include an initialization signal INI, a scan signal SCAN, and an emission signal EM to be input into pixel P during n-th (n is a positive integer) and (n+1)-th frame periods. The data signals include data voltage Vdata to be supplied to data line DL during the one or both of the n-th and (n+1)-th frame periods.

Referring to FIG. 4, initialization signal INI, scan signal SCAN, and emission signal EM control the first to fifth transistors ST1 to ST5 of pixel P. The initialization signal INI is supplied to pixel P through initialization line IL, the scan signal SCAN is supplied to pixel P through scan line SL, and the emission signal EM is supplied to pixel P through emission line EML.

Each of the initialization signal INI, scan signal SCAN, and emission signal EM is generated as a cycle of one frame period. Each of the initialization signal INI, scan signal SCAN, and emission signal EM may swing between a first logic level voltage V1 and a second logic level voltage V2. As shown in FIG. 4, the first logic level voltage V1 is a gate-on voltage and the second logic level voltage V2 is a gate-off voltage. The gate-on voltage turns on the first to fifth transistors ST1 to ST5. The gate-off voltage turns off the first to fifth transistors ST1 to ST5.

The data voltage Vdata is supplied to data line DL as a cycle of a predetermined period. For example, data voltage Vdata may be supplied to data line DL as a cycle of one horizontal period. One horizontal period may refers to one horizontal line data supplying period, during which data voltages are supplied to pixels arranged on a horizontal line. As shown in FIG. 4, the third period t3 that supplies data voltage Vdata to pixel P may be, for example, one horizontal period, but this is not a necessity.

The data voltage Vdata has a voltage level from a peak white gray scale voltage PWGV to a peak black gray scale voltage PBGV. When the peak white gray scale voltage PWGV is supplied to pixel P as data voltage Vdata, the OLED emits light of the peak white gray scale value. When the peak black gray scale voltage PBGV is supplied to pixel P as data voltage Vdata, the OLED emits a peak black gray scale value.

One frame period includes first to fourth periods t1 to t4. The first period t1 is a period in which the driving transistor is turned on and the drain-source current Ids flows through the channel of the driving transistor DT. The driving transistor is in the on-bias state during this period. The second period t2 is a period for initializing first node N1. The third period t3 is a period for supplying data voltage Vdata to the first node N1. The fourth period t4 is a period during which OLED emits light based on the drain-source current Ids of the driving transistor DT.

The scan signal SCAN and initialization signal INI are generated at first logic level voltage V1, and the emission signal EM is generated at second logic level voltage V2, during the first period t1. The initialization signal INT is generated at first logic level voltage V1, and the scan signal SCAN and emission signal EM are generated at second logic level voltage V2, during the second period t2. The scan signal SCAN is generated at first logic level voltage V1, and the initialization signal INT and emission signal EM are generated at second logic level voltage V2, during the third period t3. The emission signal EM is generated at first logic level voltage V1, and the scan signal SCAN and initialization signal INI are generated at second logic level voltage V2, during the fourth period t4. The first to fourth periods t1 to t4 may be, for example, several horizontal periods, dozens of horizontal periods, or another predetermined number of horizontal periods, for improving picture quality.

Figure 5:
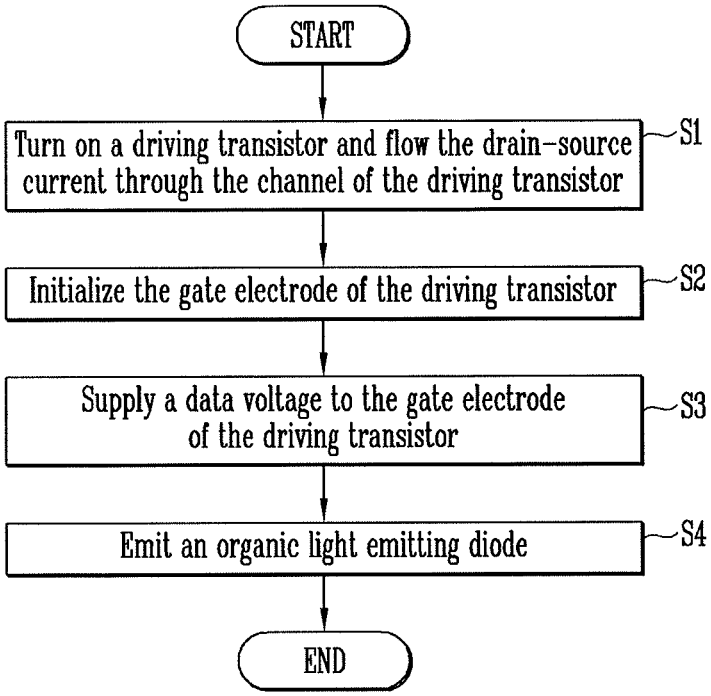
FIG. 5 illustrates an embodiment of a method for driving a pixel.

FIG. 5 illustrates an embodiment of a method for driving a pixel. FIGS. 6A to 6D illustrate different states or periods of operation of the pixel. The pixel may be, for example, pixel P previously described, and the method for driving pixel P may include first to fourth periods t1 to t4 is described above.

First, as shown in FIG. 4, during first period t1, the driving transistor is turned on and the drain-source current Ids flows through the channel of the driving transistor DT. As a result, scan signal SCAN having the first logic level voltage V1 is supplied to pixel P through scan line SL. The initialization signal INI having the first logic level voltage V1 is supplied to pixel P through initialization line IL during the first period t1. The emission signal EM having the second level voltage V2 is supplied to pixel P through emission line EML during the first period t1.

Figure 6A:
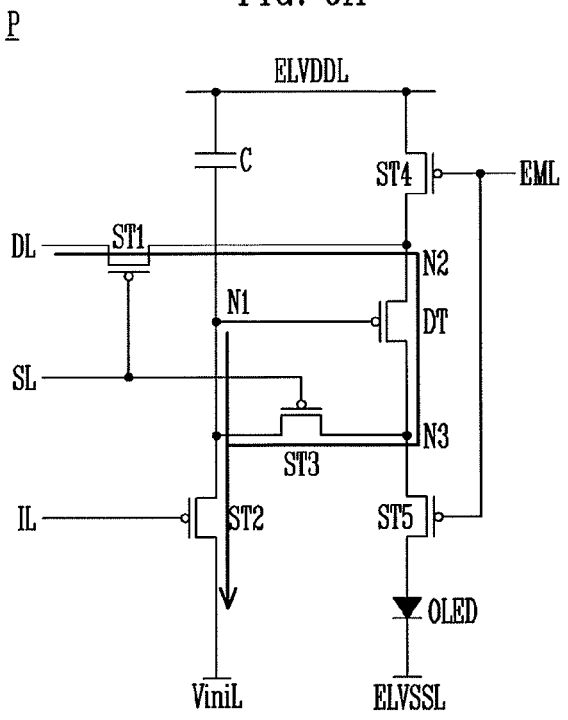
FIGS. 6A to 6D illustrate different periods of operation of a pixel.

Referring to FIG. 6A, the first and the third transistors ST1 and ST3 are turned on by scan signal SCAN having the first logic level voltage V1. The second transistor ST2 is turned on by initialization signal INI having first logic level voltage V1. The fourth and the fifth transistors ST4, ST5 are turned off by emission signal EM having the second logic level voltage V2.

The second node N2 is coupled to data line DL because the first transistor ST1 is turned on. Thus, data voltage Vdata from data line DL is supplied to second node N2. The first node N1 is coupled to initialization voltage line ViniL because second transistor ST2 is turned on. Thus, the first node N1 is initialized to initialization voltage Vini. The first node N1 is coupled to third node N3 because the third transistor ST3 is turned on. Therefore, the gate-source voltage Vgs of the driving transistor DT becomes "Vini−Vdata" during the first period t1. Accordingly, the drain-source current Ids of the driving transistor DT flows according to the "Vini−Vdata".

Finally, driving transistor DT may turn on because data voltage Vdata is supplied to second node N2, and initialization voltage Vini is supplied to first node N1 during first period t1. Therefore, driving transistor DT may be in an on-bias state before third period t3, during which data voltage Vdata is supplied to the gate electrode of the driving transistor DT. (See Si in FIG. 5). Accordingly, picture quality may be prevented from being lowered by hysteresis characteristics of the driving transistor DT. An example of this effect is described in greater detail in FIG. 7.

Second, as shown in FIG. 4, during second period t2 in which the first node N1 is initialized to initialization voltage Vini, scan signal SCAN having the second logic level voltage V2 is supplied to pixel P through scan line SL. The initialization signal INI at the first logic level voltage V1 is supplied to pixel P through initialization line IL during the second period t2. The emission signal EM having the second level voltage V2 is supplied to pixel P through emission line EML during the second period t2.

Figure 6B:
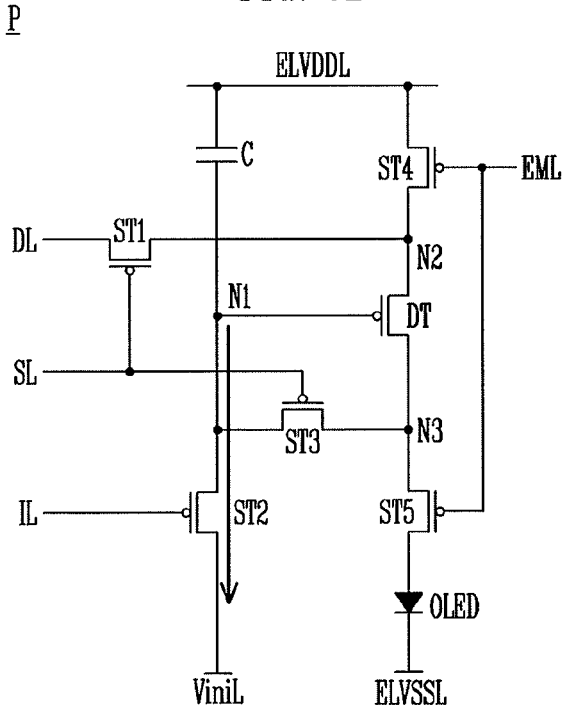

Referring to FIG. 6B, the first and the third transistors ST1, ST3 are turned off by the scan signal SCAN having the second logic level voltage V2. The second transistor ST2 is turned on by initialization signal INI having the first logic level voltage V1. The fourth and fifth transistors ST4, ST5 are turned off by emission signal EM having the second logic level voltage V2. The first node N1 is coupled to initialization voltage line ViniL because the second transistor ST2 is turned on. Thus, first node N1 is initialized to initialization voltage Vini. (See S2 in FIG. 5)

Third, as shown in FIG. 4, during the third period t3 in which data voltage Vdata is supplied to first node N1, the scan signal SCAN having the first logic level voltage V1 is supplied to pixel P through scan line SL. The initialization signal INT having the second logic level voltage V2 is supplied to pixel P through initialization line IL during the third period t3. The emission signal EM having the second level voltage V2 is supplied to pixel P through emission line EML during the third period t3.

Figure 6C:
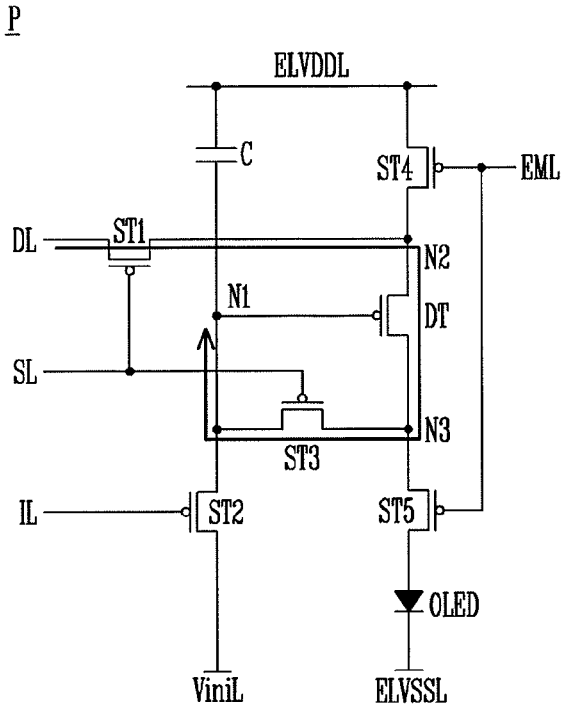

Referring to FIG. 6C, the first and the third transistors ST1 and ST3 are turned on by the scan signal SCAN having the first logic level voltage V1. The second transistor ST2 is turned off by the initialization signal INI having the second logic level voltage V1. The fourth and the fifth transistors ST4, ST5 are turned off by the emission signal EM having the second logic level voltage V2.

The second node N2 is coupled to the data line DL because the first transistor ST1 is turned on. Thus, data voltage Vdata is supplied to second node N2. The first node N1 is coupled to third node N3 because the third transistor ST3 is turned on. Thus, the driving transistor DT is diode-connected.

Because the gate-source voltage "Vini−Vdata" of the driving transistor DT is lower than the threshold voltage Vth, the driving transistor DT forms a current path until the gate-source voltage of the driving transistor DT reaches the threshold voltage Vth. Therefore, a voltage of the first node N1 rises to "Vdata+Vth." The voltage "Vdata+Vth" of the first node N1 is stored in capacitor C. For example, the threshold voltage Vth of driving transistor DT may be sensed by capacitor C during the third period t3. (See S3 in FIG. 5)

Fourth, as shown in FIG. 4, during the fourth period t4 the OLED emits light. (See S4 in FIG. 5). Also, the scan signal SCAN having the second logic level voltage V2 is supplied to pixel P through scan line SL. The initialization signal INI having the second logic level voltage V2 is supplied to pixel P through initialization line IL during the fourth period t4. The emission signal EM having the first level voltage V1 is supplied to pixel P through emission line EML during the fourth period t4.

Figure 6D:
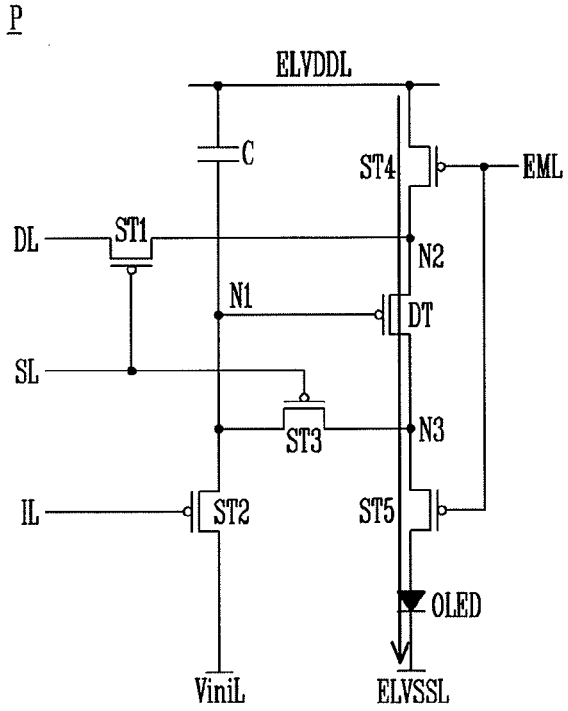

Referring to FIG. 6D, the first and the third transistors ST1 and ST3 are turned off by the scan signal SCAN having the second logic level voltage V2. The second transistor ST2 is turned off by the initialization signal INI having the second logic level voltage V1. The fourth and the fifth transistors ST4 and ST5 are turned on by the emission signal EM having the first logic level voltage V1.

The second node N2 is coupled to the first supply voltage line ELVDDL because the fourth transistor ST4 is turned on. The third node N3 is coupled to the anode of the OLED. Therefore, the drain-source current Ids of the driving transistor DT is supplied to the OLED. Because the voltage "Vdata+Vth" of the first node N1 is stored in capacitor C, the drain-source current Ids of the driving transistor DT may be expressed by Equation 2.

$$I_{ds}=k'\cdot(V_{gs}-V_{th})^2=k'\cdot((V\text{data}+Vth-ELVDD)-Vth)^2 \quad (2)$$

In Equation 2, k' is a proportionality coefficient determined by the structure and physical properties of the driving transistor DT, Vgs is the gate-source voltage of the driving transistor DT, Vth is the threshold voltage of the driving transistor DT, Vdata is the data voltage, and ELVDD is the first power voltage. The gate voltage Vg of the driving transistor DT is Vdata+Vth, and the source voltage Vs of the driving transistor DT is ELVDD during the fourth period t4.

Thus, the drain-source current Ids of the driving transistor DT may be derived as expressed in Equation 3.

$$I_{ds}=k'\cdot(V\text{data}-ELVDD)^2 \quad (3)$$

From Equation 3, it is evident that the drain-source current Ids does not depend on the threshold voltage Vth of the driving transistor DT. Thus, the threshold voltage Vth of the driving transistor DT may be compensated for.

Figure 7:
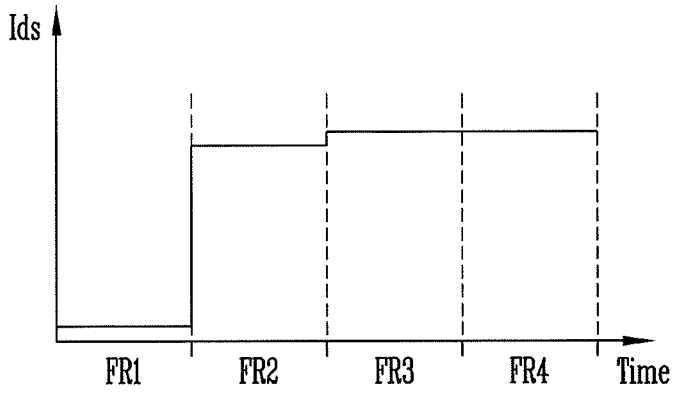
FIG. 7 illustrates a drain-source current of a driving transistor caused by hysteresis the driving transistor according to one embodiment.

FIG. 7 is a graph illustrating an example of the drain-source current of the driving transistor caused by hysteresis characteristics of the driving transistor. In FIG. 7, first frame period FR1 is a black grayscale display period in which a pixel is represented as a black gray scale value. The second to fourth frame periods FR2 to FR4 are white gray scale display periods in which the pixel emits light of at least one white gray scale value.

Referring to FIG. 7, the embodiment supplies the gate electrode of the driving transistor DT to the initialization voltage Vini and the first electrode of the driving transistor DT to the data voltage Vdata during the first period of every frame period. Therefore, the driving transistor DT may be placed in an on-bias state regardless of a gray scale voltage supplied during a previous frame period.

As shown in FIG. 7, even though the peak black gray scale voltage is supplied to the gate electrode of the driving transistor DT during the first frame period FR1, the driving transistor DT is in an on-bias state during the third period t3 of the second frame period FR2 that supplies the data voltage Vdata. This is because the driving transistor DT is turned on and the drain-source current Ids of the driving transistor DT flows during the first period t1 of the second frame period FR2. Therefore, the drain-source current Ids of the driving transistor DT during the second frame period FR2 is almost the same as during the third frame period FR3. Consequently, the OLED may emit at the peak white gray scale value during the second frame period FR2.

Accordingly, at least this embodiment may prevent the drain-source current of the driving transistor DT from increasing in steps by the hysteresis characteristics of the driving transistor, when a white gray scale image is to be displayed after a black grays scale image. Therefore, the luminance difference between white gray scale images caused by the hysteresis characteristics of the driving transistor may be reduced or minimized, especially when a white gray scale image is displayed after a black gray scale image. Picture quality may therefore be improved.

Figure 8:
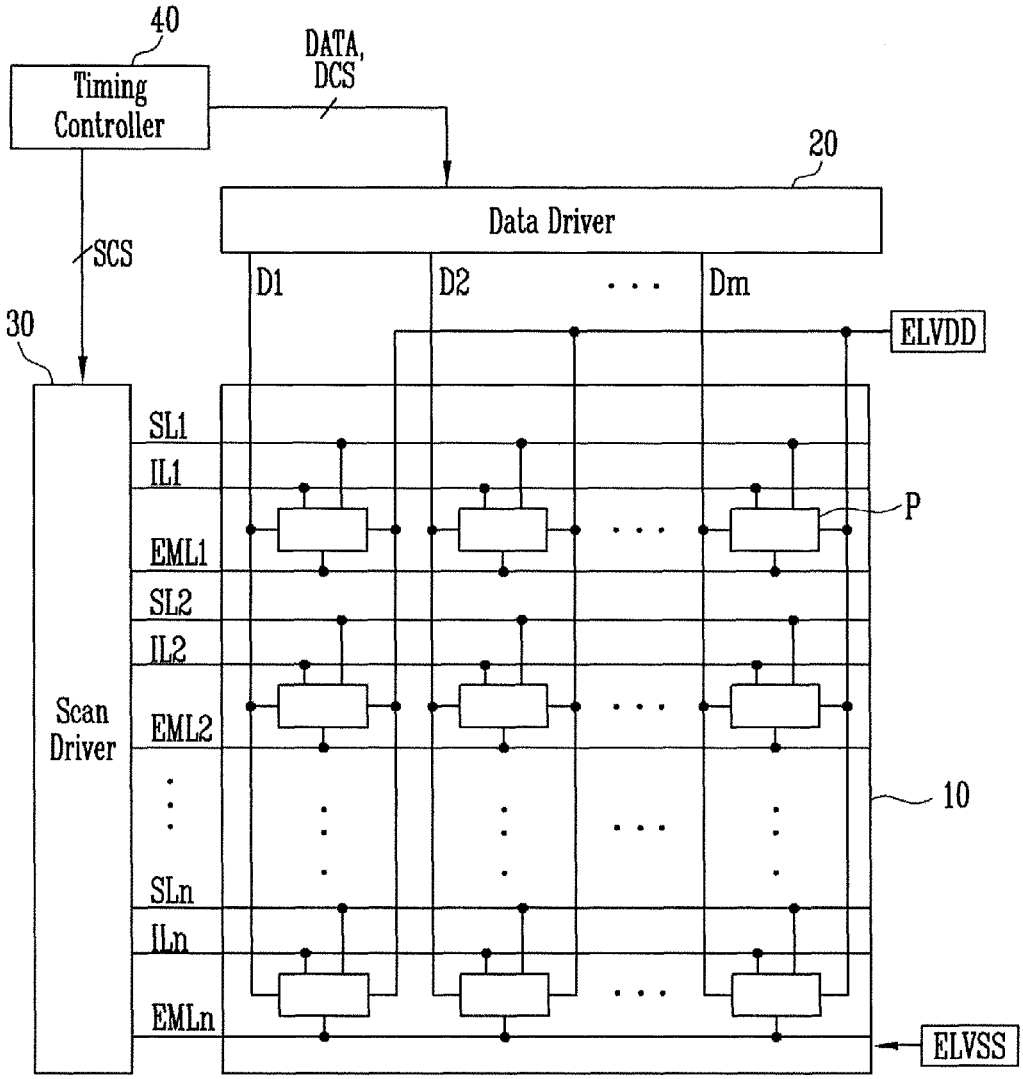
FIG. 8 illustrates an embodiment of an organic light emitting display device.

FIG. 8 illustrates an embodiment of an organic light emitting display device which includes a display panel 10, data driver 20, scan driver 30, timing controller 40, and power supply unit 50.

Data lines D1 to Dm and scan lines SL1 to SLn cross each other in display panel 10, where m≥2 and n≥2. Also, initialization lines IL1 to ILn and emission lines EML1 to EMLn may be parallel with scan lines SL1 to SLn. Also, pixels P are arranged in a matrix, where each pixels P may correspond to the pixel in FIG. 3.

The data driver 20 includes one or more source drive ICs. The source drive ICs receive digital video data RGB from timing controller 40 and convert digital video data RGB to a gamma compensation voltage in response to a source timing control signal DCS from timing controller 40. As a result, data voltages may be generated. The source drive ICs supply data voltages to data lines D1 to Dm in synchronization with scan signals SCAN. Therefore, the data voltages are supplied to pixels to which a scan signal SCAN is supplied.

The scan driver 30 includes a scan signal output section, an initialization signal output section, and an emission signal output section. Each of the scan signal output section, the initialization signal output section, and the emission signal output section includes a shift register for sequentially outputting signals, a level shifter for shifting the signals of the shift register to a swing width suitable for transistors of the pixels, and/or a buffer.

The scan signal output section sequentially outputs scan signals SCAN to scan lines SL of display panel 10. The initialization signal output section sequentially outputs initialization signals to initialization lines IL. The emission signal output section sequentially outputs emission signals EM to emission lines EML. The scan signal SCAN, initialization signal INI, and emission signal EM may be those described with reference to FIG. 4.

The timing controller 40 may receive digital video data RGB from a host system through, for example, a low voltage differential signaling (LVDS) interface or a transition minimized differential signaling (TMDS) interface. The timing controller 40 receives timing signals such as a vertical synchronization signal, a horizontal synchronization signal, a data enable signal, and/or a dot clock, and generates timing control signals for controlling operation timings of data driver 20 and scan driver 30.

The timing control signals may include a scan timing control signal for controlling the operation timing of scan driver 30, and a data timing control signal for controlling the operation timing of data driver 20. The timing controller 40 outputs the scan timing control signal to scan driver 30, and outputs the data timing control signal and digital video data RGB to data driver 20.

The power supply unit 50 supplies a first power voltage ELVDD to the pixels through first voltage supply lines ELVDDL and a second power voltage ELVSS to the pixels through the second voltage supply line ELVSSL. The first power voltage may be a high-potential voltage and the second power voltage may be a low-potential voltage.

By way of summation and review, an organic light emitting display has a plurality of pixels arranged in matrix form. Each pixel includes a scan transistor and a driving transistor. The scan transistor provides a data voltage from a data line in response to a scan signal. The driving transistor adjusts the amount of the current supplied to an organic light emitting diode based on a voltage supplied to its gate electrode.

The drain-source current Ids of the driving transistor may be supplied to an OLED according to Equation 1. However, the threshold voltage Vth of the driving transistor may shift as operation of the driving transistor deteriorates. The shift in threshold voltage Vth may differ from pixel to pixel, the driving transistors of different pixels deteriorate at different rates. As a result, the luminance of light emitted from each pixel may differ, even when the same data voltage is supplied to the pixels.

In accordance with one or more embodiments, the driving transistor DT may be turned on and drain-source current Ids may flow through the channel of the driving transistor by supplying initialization voltage Vini to the gate electrode of the driving transistor DT and data voltage Vdata to the first electrode of the driving transistor DT before data voltage Vdata is supplied to the gate electrode of driving transistor DT.

As a result, the drain-source current of the driving transistor DT may be prevented from increasing in steps by the hysteresis characteristics of the driving transistor, at least when a white gray scale image is to be displayed after a black gray scale image is displayed. Therefore, a luminance difference between white gray scale images caused by the hysteresis characteristics of the driving transistor may be reduced or minimized, when a white gray scale image is to be displayed after black gray scale image is displayed. As a result, picture quality may be improved.

The methods and processes described herein may be performed by code or instructions to be executed by a computer, processor, controller, or any other processing device. Because the algorithms that form the basis of the methods (or operations of the computer, processor, or controller) are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless specifically indicated. Accordingly, it will be understood by those of skill in the art that various changes in form and details may be made without departing from the spirit and scope of the present invention as set forth in the following claims.

What is claimed is:

1. A display device, comprising:

a display panel including data lines, scan lines, initialization lines, and a plurality of pixels, each pixel including:

a driving transistor including a gate electrode coupled to a first node, a first electrode coupled to a second node, and a drain electrode coupled to a third node, the driving transistor to control an amount of drain-source current based on a level of a voltage applied to the first node;

an organic light emitting diode (OLED) to emit light based on the drain-source current;

a first transistor coupled between the second node and a data line, the first transistor to be turned on by a scan signal of a scan line; and a second transistor coupled between the first node and an initialization voltage line to supply an initialization voltage, the second transistor to be turned on by an initialization signal of an initialization line, wherein the first and second transistors are to be turned on during a first period.

2. The display device as claimed in claim 1, wherein the pixel includes a third transistor coupled between the first node and third node, the third transistor is turned on by the scan signal during the first period.

3. The display device as claimed in claim 2, wherein the first and third transistors are turned off and the second transistor is turned on during a second period subsequent to the first period.

4. The display device as claimed in claim 3, wherein the first and third transistor are to be turned on and the second transistor is turned off during a third period subsequent to the second period.

5. The display device as claimed in claim 4, wherein the display panel includes emission lines and wherein each pixel includes:

a fourth transistor coupled between the second node and a first voltage supply line to supply a first power voltage, the fourth transistor is turned on by an emission signal of an emission line; and a fifth transistor coupled between the third node and the organic light emitting diode, the fifth transistor is turned on by the emission signal.

6. The display device as claimed in claim 5, wherein the fourth and fifth transistors are turned off during the first to third periods.

7. The display device as claimed in claim 5, wherein the first to third transistors are turned off and the fourth and fifth transistors are turned on during a fourth period subsequent to the third period.

8. The display device as claimed in claim 5, wherein the scan signal and initialization signal are generated as a first logic level voltage and the emission signal is generated as a second level voltage during the first period.

9. The display device as claimed in claim 8, wherein the initialization signal is generated as the first logic level voltage and the scan signal and emission signal are to be generated as the second level voltage during the second period.

10. The display device as claimed in claim 9, wherein the scan signal is to be generated as the first logic level voltage and the initialization signal and emission signal are generated as the second level voltage during the third period.

11. The display device as claimed in claim 10, wherein the emission signal is generated as the first logic level voltage and the scan signal and initialization signal are generated as the second level voltage during a fourth period.

12. The display device as claimed in claim 11, wherein each of the first to fifth transistors are turned on by the first logic level voltage and are turned off by the second logic level voltage.

13. The display device as claimed in claim 12, wherein each of the first to third periods includes a plurality of horizontal periods.

14. The display device as claimed in claim 5, wherein:

the first transistor includes a gate electrode coupled to the scan line, a first electrode coupled to the data line, and a second electrode coupled to the second node, the second transistor includes a gate electrode coupled to the initialization line, a first electrode coupled to the first node, a second electrode coupled to the initialization voltage line, the third transistor includes a gate electrode coupled to the scan line, a first electrode coupled to the third node, a second electrode coupled to the first node, the fourth transistor includes a gate electrode coupled to the emission line, a first electrode coupled to the first voltage supply line, a second electrode coupled to the second node, the fifth includes a gate electrode coupled to the emission line, a first electrode coupled to the third node, and a second electrode coupled to an anode of the OLED, a cathode of the organic light emitting diode coupled to a second voltage supply line to supply a second power voltage.

15. The display device as claimed in claim 1, wherein the pixel includes:

a capacitor coupled between the first node and a first voltage supply line to supply a first power voltage.

16. A method for driving a display device, the method comprising:

supplying a gate-on voltage to a driving transistor of a pixel by connecting a first electrode of the driving transistor to a data line in a first period and supplying an initialization signal to a transistor by connecting a gate electrode of the transistor to an initialization voltage line in the said first period;

supplying a data voltage to the gate electrode of the driving transistor in a second period; and controlling an organic light emitting diode (OLED) to emit light in a third period, wherein the OLED coupled to the driving transistor to emit light based on a drain-source current of the driving transistor.

17. The method as claimed in claim 16, wherein supplying the data voltage includes:

supplying the data voltage to the first electrode of the driving transistor from the data line, and connecting the gate electrode of the driving transistor to a second electrode of the driving transistor.

18. The method as claimed in claim 16, wherein controlling the OLED to emit light includes:

connecting the first electrode of the driving transistor to a first voltage supply line supplying a first power voltage, and connecting a second electrode of the driving transistor to the OLED.

* * * * *